US006345912B1

(12) United States Patent
Ho

(10) Patent No.: US 6,345,912 B1
(45) Date of Patent: Feb. 12, 2002

(54) BAG WITH CARD RETAINER

(76) Inventor: Chin-Lien Ho, No. 36, Lo-Yang Rd., Hsi-Tun Dist., Taichung City (TW)

( * ) Notice: Subject to any disclaimer, the term of this patent is extended or adjusted under 35 U.S.C. 154(b) by 0 days.

(21) Appl. No.: 09/875,224

(22) Filed: Jun. 6, 2001

(51) Int. Cl.[7] ..... B65D 33/00; B65D 33/02; B65D 33/12

(52) U.S. Cl. ..... 383/20; 383/6; 383/40; 383/127

(58) Field of Search ..... 383/6, 20, 40, 383/127, 26, 27

(56) References Cited

U.S. PATENT DOCUMENTS 560,469 A * 5/1896 Butts et al. ..... 383/6
1,349,654 A * 8/1920 Beregen ..... 383/6
1,974,457 A * 9/1934 Groh ..... 383/6
3,220,634 A * 11/1965 Rubinstein ..... 383/6
4,117,874 A * 10/1978 Berenguer ..... 383/40

* cited by examiner

*Primary Examiner*—Stephen P. Garbe
(74) *Attorney, Agent, or Firm*—Akin, Gump, Strauss, Hauer & Feld, L.L.P.

(57) ABSTRACT

A bag includes an upright bag body having a rectangular mouth portion confined by opposite longer walls and opposite shorter walls that interconnect the longer walls. At least one of the longer walls is formed with a set of first strap holes therethrough. A carrying strap has opposite sections that extend respectively through the first strap holes and that are formed with a respective knotted end for connecting the carrying strap to the bag body. A card retainer includes an upright plate with an upper part that is formed with a set of second strap holes to permit extension of the opposite sections of the carrying strap therethrough, and a folded lower part that confines an upwardly opening card receiving space adapted for holding a portion of a greeting card therein.

6 Claims, 3 Drawing Sheets

BAG WITH CARD RETAINER

BACKGROUND OF THE INVENTION

1. Field of the Invention

The invention relates to a bag, more particularly to a bag with a card retainer for retaining a greeting card.

2. Description of the Related Art

Conventional gift bags are generally formed as an upright rectangular bag body made of paper or plastic. The bag body has two opposite longer walls which are provided with a respective set of strap holes near a top opening of the bag body for extension of a string member or the like to facilitate carrying. Such a conventional gift bag provides better support over conventional soft plastic bags, and defines a generally rectangular receiving space for neat placement of articles therein. Besides, the bag body of the conventional gift bag is often printed with various patterns to enhance the appearance thereof. Some people have the habit of sending a greeting card along with a gift in a gift bag. Oftentimes, the greeting card is simply put inside the gift bag, and the recipient may not notice it immediately to be able to respond to it in an opportune time.

SUMMARY OF THE INVENTION

Therefore, the main object of the present invention is to provide a bag with a card retainer for retaining a greeting card.

Accordingly, a bag of the present invention is capable of retaining a greeting card, and includes an upright bag body, a carrying strap, and a card retainer. The bag body has a rectangular mouth portion confined by opposite longer walls and opposite shorter walls that interconnect the longer walls and that are shorter than the longer walls. At least one of the longer walls is formed with a set of first strap holes therethrough. The carrying strap has opposite sections that extend respectively through the first strap holes and that are formed with a respective knotted end for connecting the carrying strap to the bag body. The card retainer includes an upright plate with an upper part that is formed with a set of second strap holes to permit extension of the opposite sections of the carrying strap therethrough, and a folded lower part that confines an upwardly opening card receiving space adapted for holding a portion of the greeting card therein.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
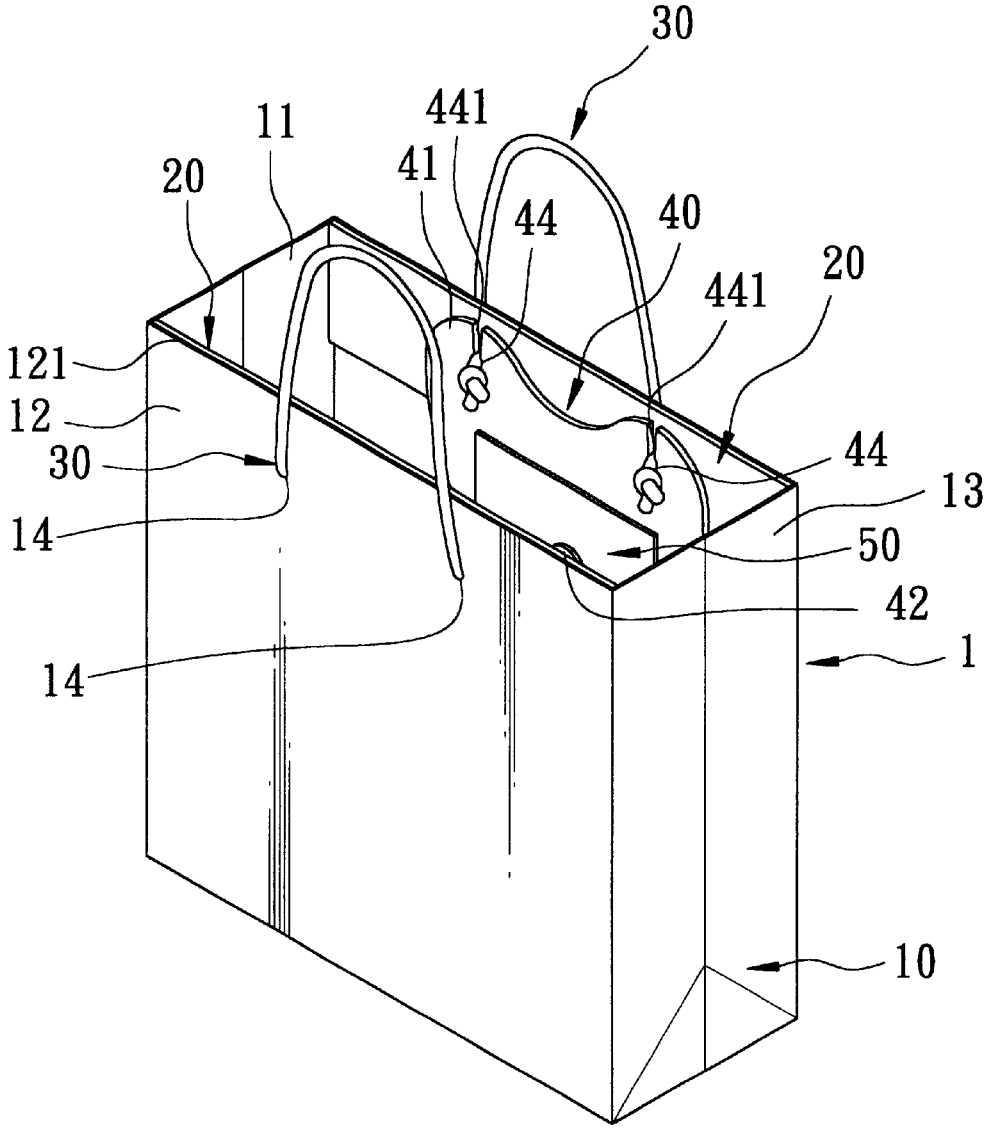
FIG. 1 is a perspective view of a preferred embodiment of a bag with a card retainer according to the present invention.
Figure 2:
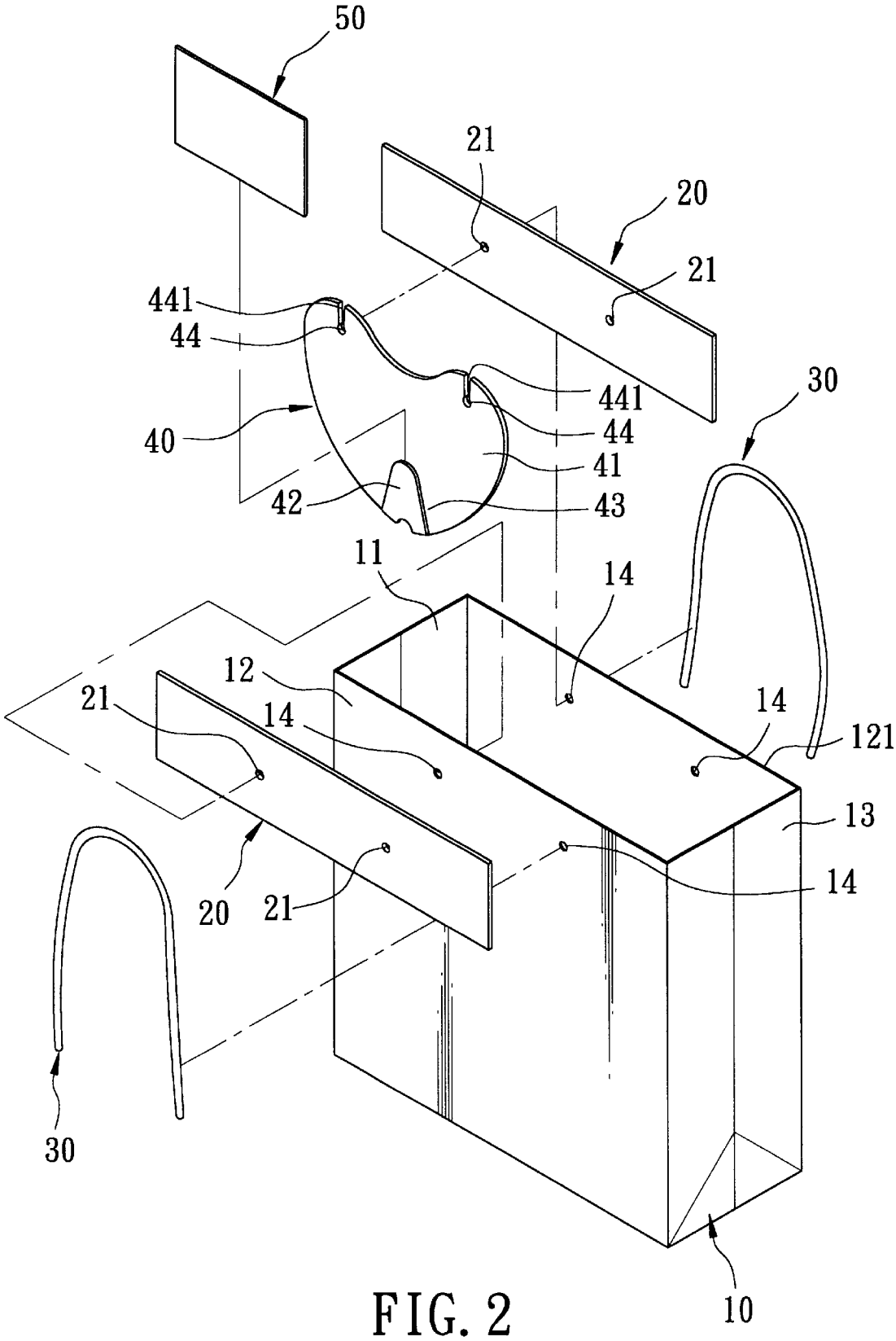
FIG. 2 is an exploded perspective view of the referred embodiment.
Figure 3:
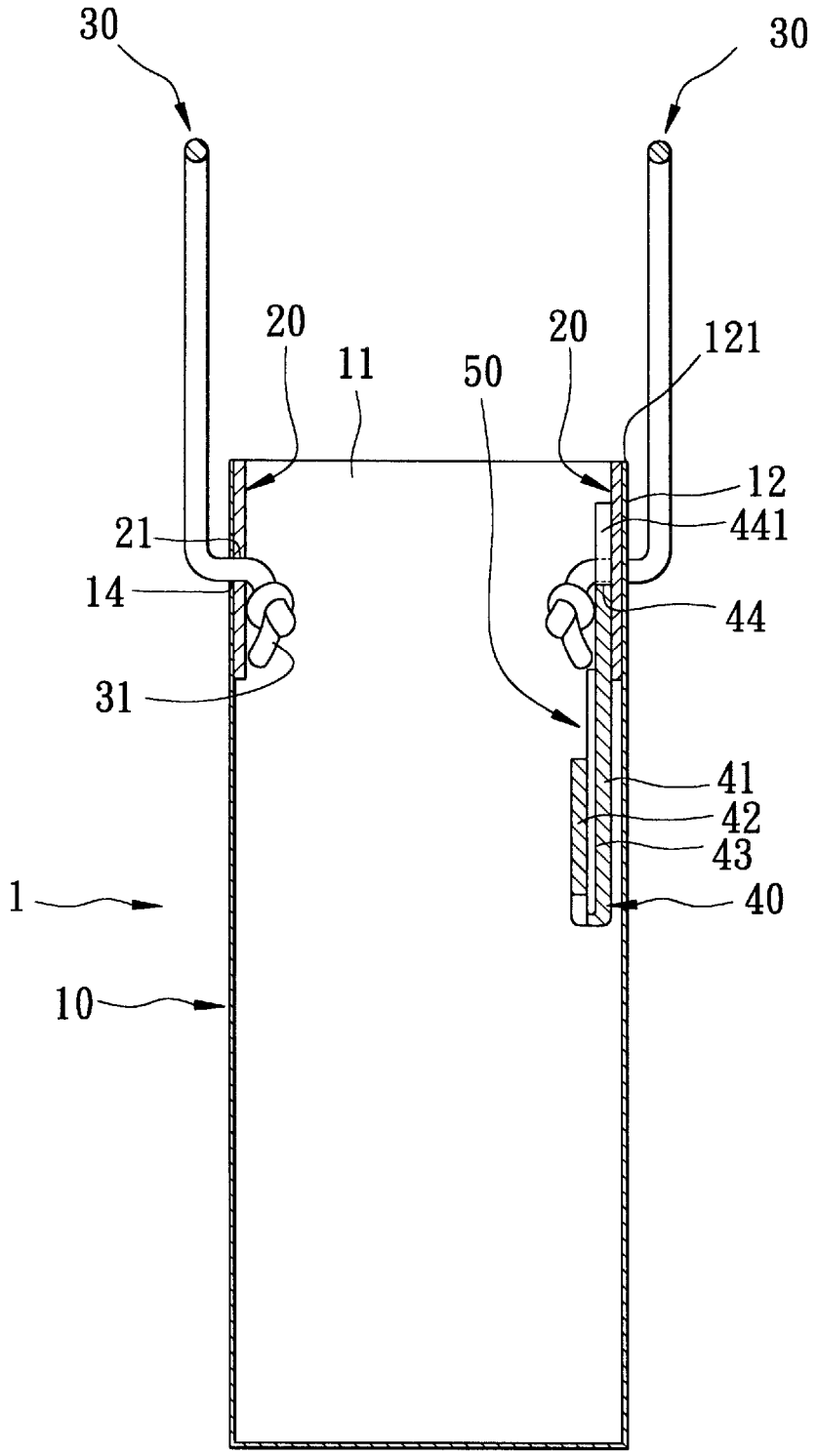
FIG. 3 is a partly sectional side view of the preferred embodiment.

Referring to FIGS. 1 to 3, the preferred embodiment of a bag 1 according to the present invention is capable of retaining a greeting card 50 and is shown to include an upright bag body 10, a carrying strap 30, and a card retainer 40.

The bag body 10 has a rectangular mouth portion 11 confined by opposite longer walls 12 and opposite shorter walls 13 that interconnect the longer walls 12 and that are shorter than the longer walls 12. Each of the longer walls 12 has a top edge 121. At least one of the longer walls 12 is formed with a set of first strap holes 14 therethrough proximate to the top edge 121. In this embodiment, both of the longer walls 12 are formed with a respective set of first strap holes 14 therethrough. Each of the shorter walls 13 has two opposite lateral edges connected foldably and respectively to the longer walls 12, and is further foldable along an upright folding line to form two shorter wall sections.

The carrying strap 30 has opposite sections that extend respectively through the first strap holes 14 and that are formed with a respective knotted end 31 for connecting the carrying strap 30 to the bag body 10. In this embodiment, the bag 1 includes two carrying straps 30 to facilitate carrying.

The card retainer 40 is preferably made of plastic, such as polypropylene, and includes an upright plate 41 with an upper part that is formed with a set of second strap holes 44 to permit extension of the opposite sections of a corresponding one of the carrying straps 30 therethrough, and a folded lower part 42 that confines an upwardly opening card receiving space 43 adapted for holding a portion of the greeting card 50 therein. The upper part of the upright plate 41 has a top edge and is further formed with a set of strap slits 441 that extend respectively from the top edge to the second strap holes 44. Each of the strap slits 441 has a width that narrows gradually from the top edge of the upper part of the upright plate 41 to the respective one of the second strap holes 44 in a substantially V-shaped configuration.

The bag 1 of the present invention further includes a backing plate 20 disposed to lie between the card retainer 40 and one of the longer walls 12 of the mouth portion 11, and formed with a set of third strap holes 21 that permit extension of the opposite sections of a respective one of the carrying straps 30 therethrough. In this embodiment, the bag 1 further includes an additional backing plate 20 disposed to lie against the other one of the longer walls 12.

During assembly, each of the backing plates 20 is disposed to rest against an inner surface of a respective one of the longer walls 12 such that the third strap holes 21 are aligned with the first strap holes 14. Then, the opposite sections of each of the carrying straps 30 are extended in sequence through the first and third strap holes 14, 21, respectively, and are formed with the knotted ends 31 that are disposed inboard to the respective one of the longer walls 12. Thereafter, the strap slits 441 in the card retainer 40 are aligned with the knotted ends 31 of the opposite sections of one of the carrying straps 30, and the opposite sections are subsequently slid along the two strap slits 441 for retention in the second strap holes 44. As such, the card retainer 40 can be attached to the carrying strap 30 in a stable manner. When it is desired to remove the card retainer 40 from the bag body 10, the card retainer 40 can be easily detached from the carrying strap 30 by slipping the opposite sections out of the second strap holes 44 and along the strap slits 441.

It is noted that although the card retainer 40 is disposed inboard to a respective one of the longer walls 12 in this embodiment, the card retainer 40 can also be disposed outboard thereto.

As the bag 1 of the present invention provides a card retainer 40 to allow the user to place a greeting card 50 therein, when the bag 1 is used as a gift bag, the recipient of the gift can immediately notice the presence of the greeting card 50. Moreover, the card retainer 40 can be attached to or detached from the bag body 10 in a very convenient manner.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A bag capable of retaining a greeting card, said bag comprising:

an upright bag body having a rectangular mouth portion confined by opposite longer walls and opposite shorter walls that interconnect said longer walls and that are shorter than said longer walls, at least one of said longer walls being formed with a set of first strap holes therethrough;

a carrying strap having opposite sections that extend respectively through said first strap holes and that are formed with a respective knotted end for connecting said carrying strap to said bag body; and a card retainer including an upright plate with an upper part that is formed with a set of second strap holes to permit extension of said opposite sections of said carrying strap therethrough, and a folded lower part that confines an upwardly opening card receiving space adapted for holding a portion of the greeting card therein.

2. The bag of claim 1, wherein said upper part of said upright plate has a top edge and is further formed with a set of strap slits that extend respectively from said top edge to said second strap holes.

3. The bag of claim 2, wherein each of said strap slits has a width that narrows gradually from said top edge of said upper part of said upright plate to the respective one of said second strap holes.

4. The bag of claim 1, wherein said card retainer is made of plastic.

5. The bag of claim 1, further comprising a backing plate disposed to lie between said card retainer and one of said longer walls of said mouth portion, and formed with a set of third strap holes that permit extension of said opposite sections of said carrying strap therethrough.

6. The bag of claim 1, wherein each of said shorter walls has two opposite lateral edges connected foldably and respectively to said longer walls, each of said shorter walls of said bag body being further foldable along an upright folding line to form two shorter wall sections.

* * * * *